US005435048A

United States Patent [19]

Walker

[11] Patent Number: 5,435,048

[45] Date of Patent: Jul. 25, 1995

[54] THREAD FRAME FOR FORMING A PATTERN

[76] Inventor: Leslie A. Walker, 329 S. Mayfair Ave. #216, San Francisco, Calif. 94015

[21] Appl. No.: 259,906

[22] Filed: Jun. 15, 1994

[51] Int. Cl.[6] ..... D03D 29/00

[52] U.S. Cl. ..... 28/149; 38/102.91

[58] Field of Search ..... 289/18.1, 16.5, 17, 289/18.1; 223/120; 28/149, 150, 151, 152; 139/34; 38/102.91

[56] References Cited

U.S. PATENT DOCUMENTS

| | | | |
|---|---|---|---|
| 2,218,994 | 10/1940 | Ryan . | |
| 2,244,085 | 6/1941 | Schneidewendt . | |
| 2,795,031 | 6/1957 | Gierling et al. . | |
| 3,922,804 | 12/1975 | Batey | 38/102.91 |
| 3,971,417 | 7/1976 | Gentil | 139/34 |
| 4,001,941 | 1/1977 | Cruz . | |
| 4,045,061 | 8/1977 | Fierro . | |
| 4,046,171 | 9/1977 | Wilson . | |
| 5,231,742 | 8/1993 | Macbain | 28/151 |
| 5,284,186 | 2/1994 | Bontshek | 28/152 |
| 5,293,704 | 3/1994 | Brown | 38/102.91 X |

FOREIGN PATENT DOCUMENTS

| | | | |
|---|---|---|---|
| 5271 | 3/1894 | Sweden | 289/18.1 |

*Primary Examiner*—Andrew M. Falik
*Attorney, Agent, or Firm*—Bielen, Peterson & Lampe

[57] ABSTRACT

An apparatus for forming a pattern utilizing a line which interacts with a frame member. The frame member includes at least a first portion and a second portion spaced from each other. First and second collar elements are rotatably attached to the first and second portions of the frame member. Each of the first and second collar elements possess a plurality of flexible fingers, each finger being capable of releasably holding the line. The frame members may be straight, angulated, or curved as desired.

8 Claims, 2 Drawing Sheets

FIG. 3
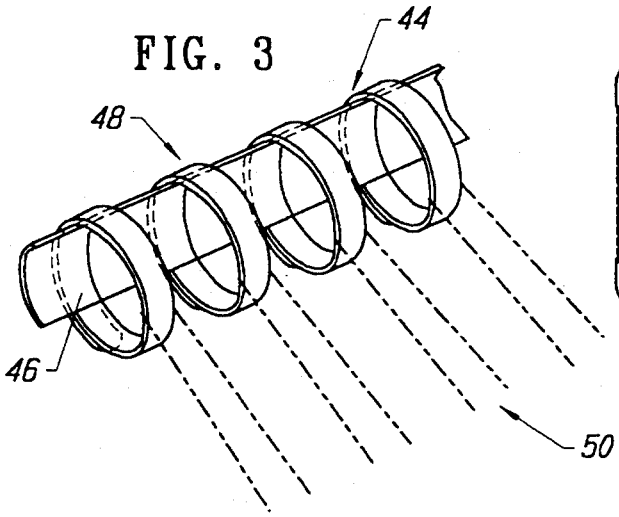
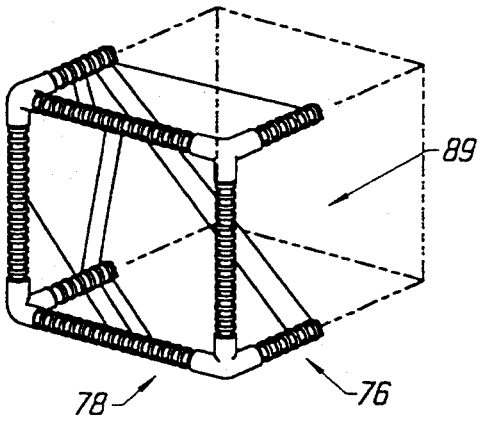
FIG. 7
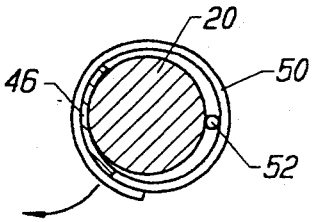
FIG. 4
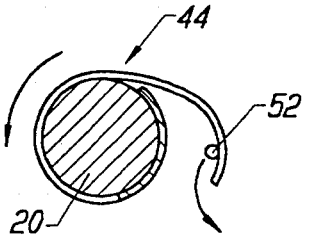
FIG. 5
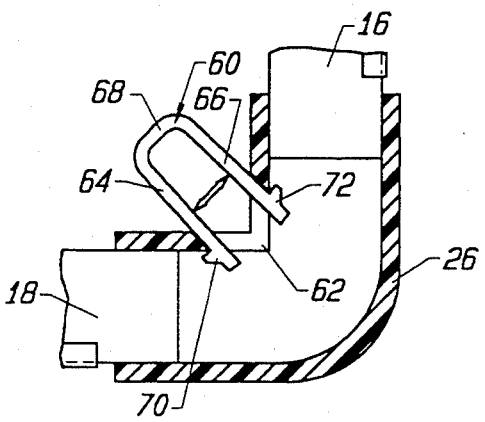
FIG. 6

THREAD FRAME FOR FORMING A PATTERN

BACKGROUND OF THE INVENTION

The present invention relates to a novel and useful apparatus for forming a pattern utilizing a line.

Looms have been employed since ancient times to interlace threads or yarns to form a cloth. The offshoot of the looming art is the craft of macrame where a coarse lace or fringe is constructed by knotting threads or chords in geometrical patterns.

U.S. Pat. Nos. 2,218,994, 2,244,085, and 4,046,171 describe looms which may be employed to form articles that are generally woven in odd configuration.

U.S. Pat. No. 4,001,941 shows an apparatus utilized to form a grid portion in order to reproduce graphic arts.

U.S. Pat. Nos. 2,795,031 and 4,045,061 show frames that are used to knot or lace articles.

An apparatus which is capable of forming a pattern of great variation would be a notable advance in the arts and crafts field.

SUMMARY OF THE INVENTION

In accordance with the present invention a novel and useful apparatus for forming a pattern utilizing a line is herein provided.

The apparatus of the present invention includes a frame member having at least a first portion and a second portion spaced from one another. The frame may include a great number of additional portions dependant on the type of pattern to be formed by the apparatus of the present invention. Each portion of the frame member may be straight, curved, or angulated, as the case may be. The frame member may be constructed in a permanent configuration or be formed of components parts that may be assembled in a variety of shapes. Thus, the frame member may be formed with a third portion, or more portions, spaced from the first and second portions and connected thereto, in most cases. For example, the frame member may take the form of a cube, pyramid, a hexagonal solid, and the like. Generally, the first, second, and third portions of the frame member are elongated.

First and second collar elements are also included in the present invention and are rotatably attached to the first and second portions, respectively, of the frame member. Each collar element includes a flexible base portion which at least partially surrounds the particular portion of the frame member. The base of the collar element is separable and removable from the portion of the frame member, the purpose of which will be described hereinafter. Each collar element terminates in a plurality of flexible fingers which are capable of holding a line, preferably by looping the line around each of the fingers.

In the case of the frame member including a corner at the juncture of the first and second portions, the present invention also provides for a removable or replaceable clip which is capable of releasably holding the line. The releasable clip may include a pair of legs which are resiliently linked to one another through a curved or bent portion. The frame member would include at least one recess for engaging the pair of legs to hold the same in place when the line is looped through the corner clip.

The collar element, being rotatably attached to each portion of the frame member, may be rotated to release tension on the line looped through the same. Prior to such rotation, the line is led between frame portions and fingers extending from the respective collar portions may be stiffened by the application of starch, lacquer, or other chemical compound. As heretofore described, rotation of each collar member releases the tension on the line. Subsequent separation of the fingers from the base portion of the collar element completely releases the line from the collar element leaving a free standing pattern or object.

It may be apparent that a novel and useful apparatus for forming a pattern utilizing a line has been described.

It is therefore an object of the present invention to provide an apparatus for forming a pattern utilizing a line which may be employed to form a large variety of patterns quickly and easily.

Another object of the present invention is to provide an apparatus for forming a pattern utilizing a line which may be employed to form a pattern and be quickly and easily released following solidification of the pattern for further use at a later time.

Yet another object of the present invention is to provide an apparatus for forming a pattern utilizing a line which may be assembled into a variety of shapes and, thus, produce a pattern of a predetermined shape and size.

Another object of the present invention is to provide an apparatus for forming a pattern which may be used by students of the arts at an early age.

The invention possesses other objects and advantages especially as concerns particular characteristics and features thereof which will become apparent as the specification continues.

BRIEF DESCRIPTION OF THE DRAWINGS

FIG. 3 is a perspective view of the collar element used in conjunction with the frame of the present invention.

FIG. 4 is a sectional view taken along line 4—4 of FIG. 1.

FIG. 5 is a sectional view similar to FIG. 4, but showing the flexing of a finger of the collar.

FIG. 6 is a sectional view of a corner of the embodiment of the present invention depicted in FIGS. 1 and 2.

FIG. 7 illustrates the frame member of the invention in the form of a cube.

Figure 1:
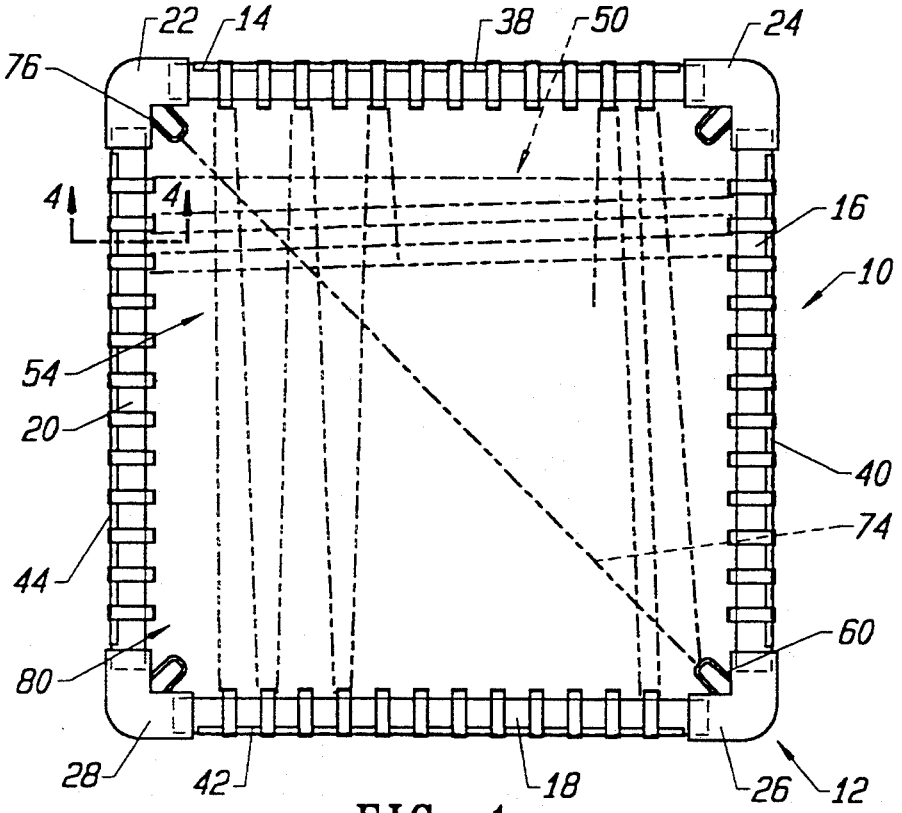
FIG. 1 is a top plan view of an embodiment of the frame member of the present invention.

For a better understanding of the invention reference is made to the following detailed description of the preferred embodiments thereof which should be referenced to the prior described drawings.

DETAILED DESCRIPTION OF THE PREFERRED EMBODIMENTS

Various aspects of the present invention will evolve from the following detailed description of the preferred embodiments thereof which should be referenced to the prior described drawings.

The invention as a whole is shown in the drawings by reference character 10. The apparatus 10 includes as one of its elements a frame member 12. Frame member 12 depicted in FIG. 1 includes first portion 14, second portion 16, third portion 18, and the fourth portion 20. Frame portions 14, 16, 18, and 20 are depicted as elongated tubes that are connected in a square shape by elbows 22, 24, 26, and 28. With reference to FIG. 2, it may be observed that frame member 30 is depicted to be in the shape of approximately the same periphery as frame member 12. However, frame member 30 includes tees 32 and 34 which permit the use of curved frame portion 36 therebetween.

Frame members 12 and 30 are formed with collar elements 38, 40, 42, and 44. Exemplar collar element 44, FIG. 3, indicates that collar element 44 is rotatably attached to fourth portion 20 of frame member 12. Exemplar collar element 44 may be easily attached to any of the portions of frame members 12 or 30. With reference to FIG. 3, it may be apparent that exemplar collar element 44 includes a base portion 46 and a plurality of flexible fingers 48, each of which is capable of extending from base portion 46 and overlapping it by being positioned completely around said base portion 46. With reference to FIG. 4, it may be seen that flexible finger 50 has been closed around frame portion 20 to hold collar element 44 to the same. In addition, flexible finger 50 fits around frame portion 20 loosely enough to permit line 52 to lie between flexible finger 50 and frame portion 20. Referring to FIG. 5, it may be seen that collar element 44 has been rotated about frame portion 20 such that line 52 is capable of leaving the confines between flexible finger 50 and frame portion 20 as desired.

Referring back to FIG. 1, it may be observed that line 50 has been laced between frame members 16 and 20 and is held thereto by collar elements 40 and 44, respectively. In addition, a line 54 has been run between frame elements 14 and 18 and held thereto by collar elements 38 and 42, respectively. Referring to FIG. 2, in particular, collar element 39 has been employed with curved frame portion 36 to permit a line 56 to run between frame portion 36 and frame portion 14 of frame member 30.

Figure 2:
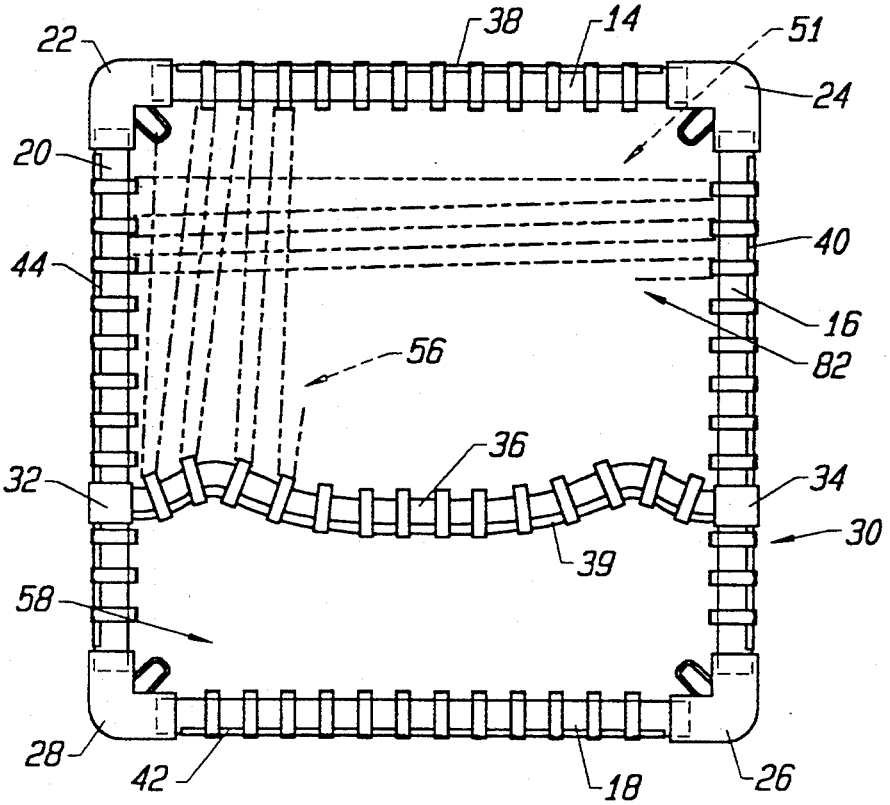
FIG. 2 is a top plan view of another frame member embodiment of the present invention.

FIGS. 1 and 2 also depict corners formed by elbows 22, 24, 26, and 28 of frame members 12 and 30. Releasable clips 58 are employed with respect to frame members 12 and 30 to permit lines, such as line 56 on FIG. 2, to be held at this juncture. Referring to FIG. 6, it may be observed that clip 60 is illustrated at elbow 26, FIG. 1. Elbow 26 is provided with a recess 62 such that releasable clip 60 may fit therein. Releasable clip 60 is formed with legs 64 and 66 which are springy relative to bent portion 68 thereof. Protuberances 70 and 72 on legs 64 and 66, respectively, prevent clip 60 from pulling from recess 62 under the tension of a line. Referring to FIG. 1, line 74 is depicted between releasable clip 60 and releasable clip 76 at elbows 26 and 22, respectively.

Although apparatuses 10 and 30 have been shown in FIGS. 1 and 2 as possessing essentially only two essential dimensions, FIG. 7 illustrates frame member 76 in the form of a cube. Other solid geometric shapes, straight or curved, may be formed in the present apparatus 10 since the frame portions and connectors such as elbows 22, 24, 26, and 28 may be removably attached to one another. FIG. 7 depicts a plurality of riser tees 78 forming the corners of the cube of frame member 76.

In operation, the user obtains or forms frame member 12, 30, or 76, or another shape as desired. Plurality of collar elements such as collars 38, 40, 42, and 44 with respect to frames 12 and 30 are attached to the frame portions as depicted in FIGS. 1 and 2 by opening the plurality of flexible fingers 48 and passing the same over the particular side portion of frame member 12 or 30. Line such as lines 51, 52, 54, 56, or 74 may be passed between any of the fingers of plurality of fingers 48 of any of the collar elements depicted therein by stretching the same relative to base portion 46. Thus, pattern 80, FIG. 1, is formed with respect to frame member 12, pattern 82, FIG. 2, is formed employing frame member 30, and another pattern 84 is formed with respect to frame 76, FIG. 7. Patterns 80, 82, and 84 may be stiffened or made rigid by the use starch, lacquer, or other chemical which may be sprayed on the lines found in frames 12, 30, or 76. Following such stiffening process, each of the collar element such as collar element 44, may be rotated about any of the frame portions such as frame portion 20, to permit the easy release of the lines held thereby. Plurality of releasable clips 58 may be removed from any of the corners of frame members 12, 30, or 76 by squeezing each of the springy legs, such as springy legs 64 and 66 with respect to clip 60, together and permit the removal from exemplar recess 62 with respect to elbow 26. Thus, each of the frames 12, 30, and 76 are reusable or may be assembled into different shapes for reuse.

While in the foregoing, embodiments of the present invention have been set forth in considerable detail for the purposes of making a complete disclosure of the invention, it may be apparent to those of skill in the art that numerous changes may be made in such details without departing from the spirit and principles of the invention.

What is claimed is:

1. An apparatus for forming a pattern utilizing a line comprising:

a. a frame member having at least a first portion spaced from a second portion; and b. a first and second collar element, said first and second collar elements being rotatably attached to said first and second portions of said frame member respectively to permit rotatable movement between said first and second collar elements and said first and second portions of said frame member, each of said first and second collar elements including a base member and a plurality of flexible fingers extending from said base member, each of said plurality of flexible fingers being formed to overlap said base member and at least one of said first and second frame member portions to releasably hold the line.

2. The apparatus of claim 1 in which said collar element includes a flexible base, said plurality of flexible fingers extending from said flexible base.

3. The apparatus of claim 2 in which said flexible base of said collar element partially surrounds said frame member.

4. The apparatus of claim 1 in which said frame further includes a third portion, said first, second, and third portions of said frame member extending in three distinct directions.

5. The apparatus of claim 4 in which said first, second, and third portions of said frame member elongated.

6. The apparatus of claim 1 which additionally comprises a corner in which said first and second portions of said frame member meet one another, said corner including a releasable clip capable of releasably holding the line.

7. The apparatus of claim 5 in which said releasable clip includes a pair of legs resiliently linked to one another through a bent portion, said frame member including at least one recess for engaging said pair of legs.

8. The apparatus of claim 1 in which said first and second portions of said frame member are elongated.

* * * * *